US005772787A

United States Patent [19]

Weishew

[11] Patent Number: 5,772,787

[45] Date of Patent: Jun. 30, 1998

[54] METHOD OF CLEANING AND MAINTAINING VISCOSITY AND PH DEVICES FOR WATER BASED FLEXO INKS

[75] Inventor: Joseph John Weishew, Oreland, Pa.

[73] Assignee: The Langston Corporation, Cherry Hill, N.J.

[21] Appl. No.: 479,479

[22] Filed: Jun. 6, 1995

[30] Foreign Application Priority Data

Jan. 18, 1995 [GB] United Kingdom ..... 9500937

[51] Int. Cl.[6] ..... B08B 3/00; B08B 7/00

[52] U.S. Cl. ..... 134/26; 134/42; 101/425

[58] Field of Search ..... 134/32, 10, 42, 134/117, 26, 18, 38; 101/425

[56] References Cited

U.S. PATENT DOCUMENTS

| | | | |
|---|---|---|---|
| 2,597,472 | 5/1952 | Gray | 259/95 |
| 3,734,119 | 5/1973 | Nudds | 137/92 |
| 3,896,730 | 7/1975 | Garrett et al. | 101/425 |
| 4,175,489 | 11/1979 | Gattus | 101/366 |
| 4,534,291 | 8/1985 | Sabota et al. | 101/426 |
| 4,552,165 | 11/1985 | Luska | 137/3 |
| 4,735,227 | 4/1988 | Royse et al. | 137/92 |
| 5,003,877 | 4/1991 | Yano et al. | 101/363 |

*Primary Examiner*—Zeinab El-Arini

*Attorney, Agent, or Firm*—Seidel, Gonda, Lavorgna & Monaco, PC

[57] ABSTRACT

A method of and apparatus for cleaning and maintaining measuring devices, in particular viscosity and pH devices, for water based Flexo inks wherein the device for measuring a parameter of the inks are mounted to a platform such as a lid adapted to cover either a cleaning container or an ink container. A cylinder raises and lowers the lid and the device for measuring a parameter of the inks in and out of the cleaning container or the ink container. A carriage carrying the cleaning container and adapted to receive the ink container moves horizontally when the lid is raised such that either the ink container or the cleaning container underlies the lid and the measuring devices. With the lid lowered on to the cleaning container, the device for measuring a parameter of the inks are washed and rinsed in the cleaning container. The device for measuring a parameter of the inks are stored in the cleaning container until returned to the ink container for use.

14 Claims, 5 Drawing Sheets

METHOD OF CLEANING AND MAINTAINING VISCOSITY AND PH DEVICES FOR WATER BASED FLEXO INKS

FIELD OF THE INVENTION

This invention relates to an inking system using a water based ink in a flexographic printing system and more particularly to a method of automatically cleaning and maintaining measuring devices for the water based ink.

BACKGROUND OF THE INVENTION

In printing, there are numerous ways of transferring the ink to a substrate on which to print. One of these methods of printing is flexographic printing, which is a process that uses rubber or another suitable material as a printing plate carried on a cylinder, to convey the image to the substrate, such as a corrugated board.

An inherent problem in printing, including flexographic printing, is that each of the various inks the printer receives has its own distinct material properties. Also, material properties of a single ink can vary from lot to lot. A blue ink might have a certain viscosity and pH, while a different color ink could be more viscous and more acidic. A printer desires to know the material properties of the ink, because the viscosity of the ink affects the flow rate of the ink and the transfer rate between cylinders and the cylinders and the substrate, and the pH of the ink affects the pigments in the ink stay in suspense and therefore the drying rate of the ink. The printer wants to print in the order of the wettest ink to the driest ink (i.e., from more acidic to less acidic).

It has been recognized that pH and viscosity measuring devices could be placed in the ink system so that these properties of the ink could be measured. These measuring devices are inserted and removed manually from the ink system. These measuring devices are cleaned by hand, away from the machine. One of the shortcomings of this method and, in particular, this type of cleaning method, is that the measuring devices are usually damaged in the process. While the measuring devices are not fragile, they are typically not sturdy enough for the abuse that they are subject to in a box making or printing plant. In addition, the pH probe or measuring device should be kept moist, such as in water or ink, and if the pH probe drys out because of being left out of a liquid, it no longer functions properly.

It has also been recognized that the rollers and tubes to transfer the ink from a storage container to the substrate need to be cleaned. Included in the rolls that need to be cleaned is an anilox roll, the roll that is used in transporting the ink from the ink container to the substrate. The anilox roll has numerous small cells on its surface to hold the ink. The number of cells can vary from 30,000 to 300,000 cells per square inch. One method of cleaning flexographic printing machines including the anilox rolls is to in those areas that carry ink substitute a water and detergent mix and a then water rinse for the ink. One of embodiments of this method is a power wash system. The power wash system comprises automatically raising the ink pump out of the ink container and placing it in a wash container that is moved under the pump. The pump moves the water and detergent mix through tubing that typically carries the ink to locations that receive the ink, including the anilox roll.

It is desired to have a method of cleaning the measuring devices such that they are not subject to the rough handling typical of the plant, and to further ensure that the pH probe does not dry out.

SUMMARY OF THE INVENTION

The present invention provides a method of and apparatus for cleaning and maintaining measuring devices, in particular viscosity and pH devices, for water based Flexo inks. The ink measuring devices are mounted to a platform such as a lid adapted to cover either a cleaning container or an ink container. A cylinder raises and lowers the lid and the ink measuring devices in and out of the cleaning container or the ink container. A carriage carrying the cleaning container and adapted to receive the ink container moves horizontally when the lid is raised such that either the ink container or the cleaning container underlies the lid and the measuring devices. With the lid lowered on to the cleaning container, the ink measuring devices are washed and rinsed in the cleaning container. The ink measuring devices are stored in the cleaning container until returned to the ink container for use.

One object, feature, and advantage resides in the provision of the ink measuring devices being stored in the cleaning container until returned to the ink container for use therein protecting the measuring devices and storing them in the proper environment.

In the preferred embodiment, the lid retains an ink circulation pump, a viscosity measuring device, a pH measuring device and a conductive type liquid sensing probe.

Another object, feature, and advantage resides in the provision of the cylinder raising and lowering the lid and the pump, the ink measuring devices and liquid sensing probe in and out of the cleaning container or the ink container in a pure vertical motion such that the pump, the ink measuring devices and the liquid sensing probe do not hit the container as they move.

Other objects, aspects, and advantages of the present invention will be apparent to those skilled in the art upon reading the specification, drawings, and claims which follow.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
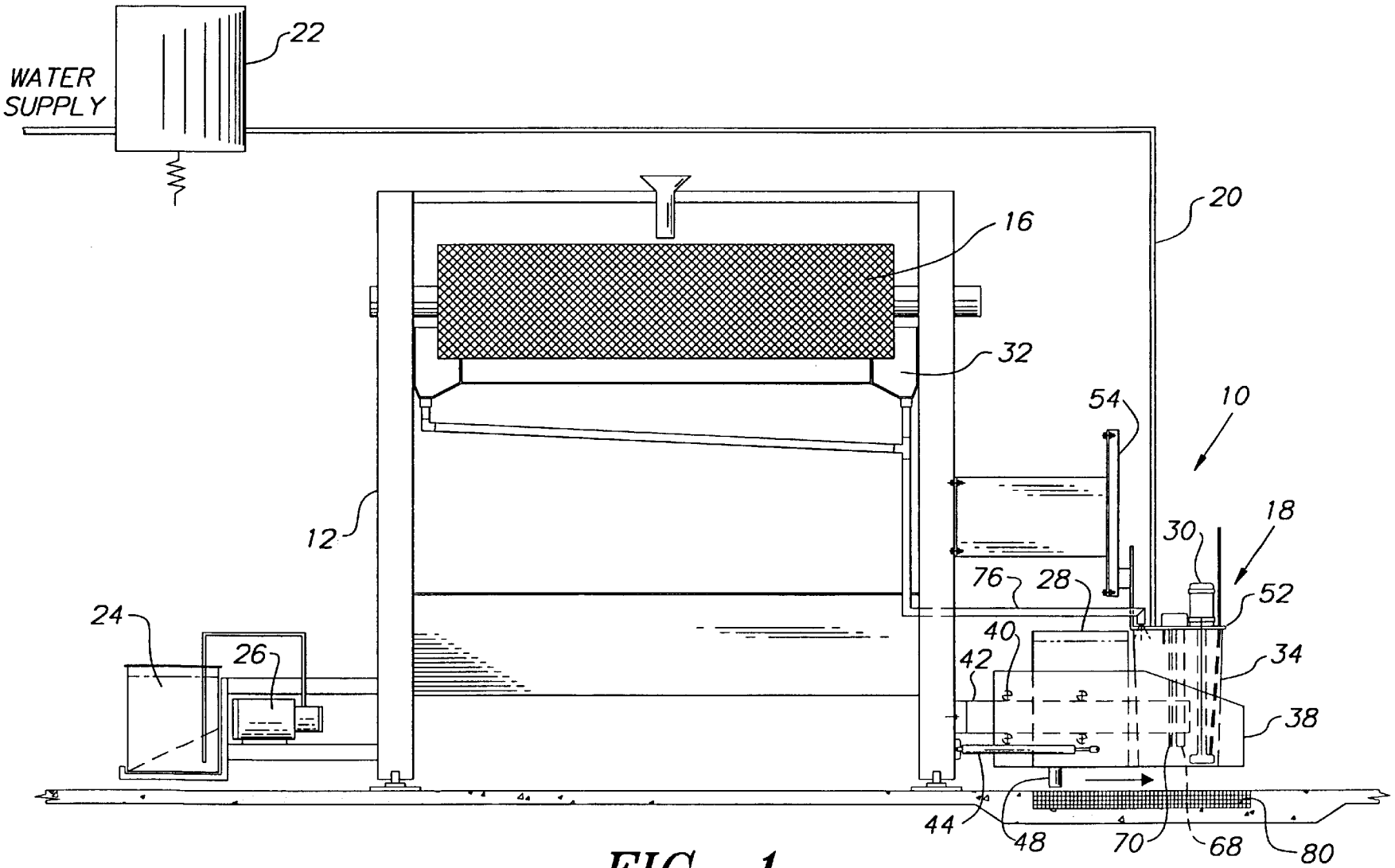
FIG. 1 is a front elevational view of a print station of a flexo folder gluer, having an apparatus for cleaning and maintaining measuring devices in accordance with the present invention.

Referring to the drawings, where like elements are identified by like numerals, there is shown in FIG. 1 a preferred embodiment according to the invention of an on press apparatus designated by numeral 10 for automatically cleaning and maintaining measuring devices, such as viscosity or pH measuring devices, for water based flexo inks.

Referring to FIG. 1, a print station 12 in a corrugated box manufacturing machine, commonly referred to as a flexo folder gluer, prints on the upper surface of a corrugated board, not shown, as the board passes through the print station 12. The print station 12 has a series of cylinders or rolls to place a desired image of ink on the corrugated board, including an anilox roll 16. The cylinders and rolls on the print station 12 including the anilox roll 16, need to be cleaned periodically and, in addition, whenever the color of ink being used on the print station 12 is changed.

One method of cleaning the rolls uses an automatic power wash system 18. The automatic power wash system 18 has tubing 20, not all shown for clarity, connecting a water supply 22, a detergent reservoir 24 and pump 26, a cleaning container, herein referred to as a wash chamber, 28, and an ink circulation pump 30 to ink troughs and drain troughs 32 associated the cylinders and rollers including the anilox roller 16. In order to clean the print station 12, the ink circulation pump 30 is raised out of an ink container 34 and into the wash chamber 28. A mixture of hot water and detergent is pumped through the system 18 with the ink circulation pump 30 thoroughly cleaned in the wash chamber 28. The system 18 is then rinsed with clean hot water.

Figure 5:
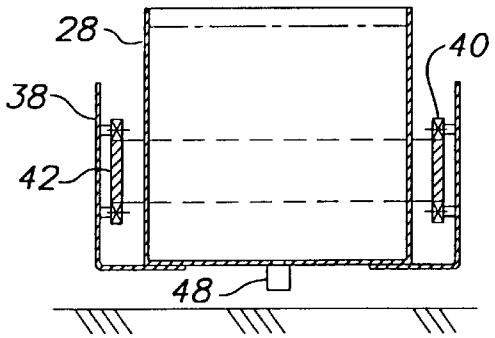
FIG. 5 is a cross-sectional view taken along line 5—5 in FIG. 2 of the wash enclosure and the moveable carriage carrying the wash enclosure.
Figure 2:
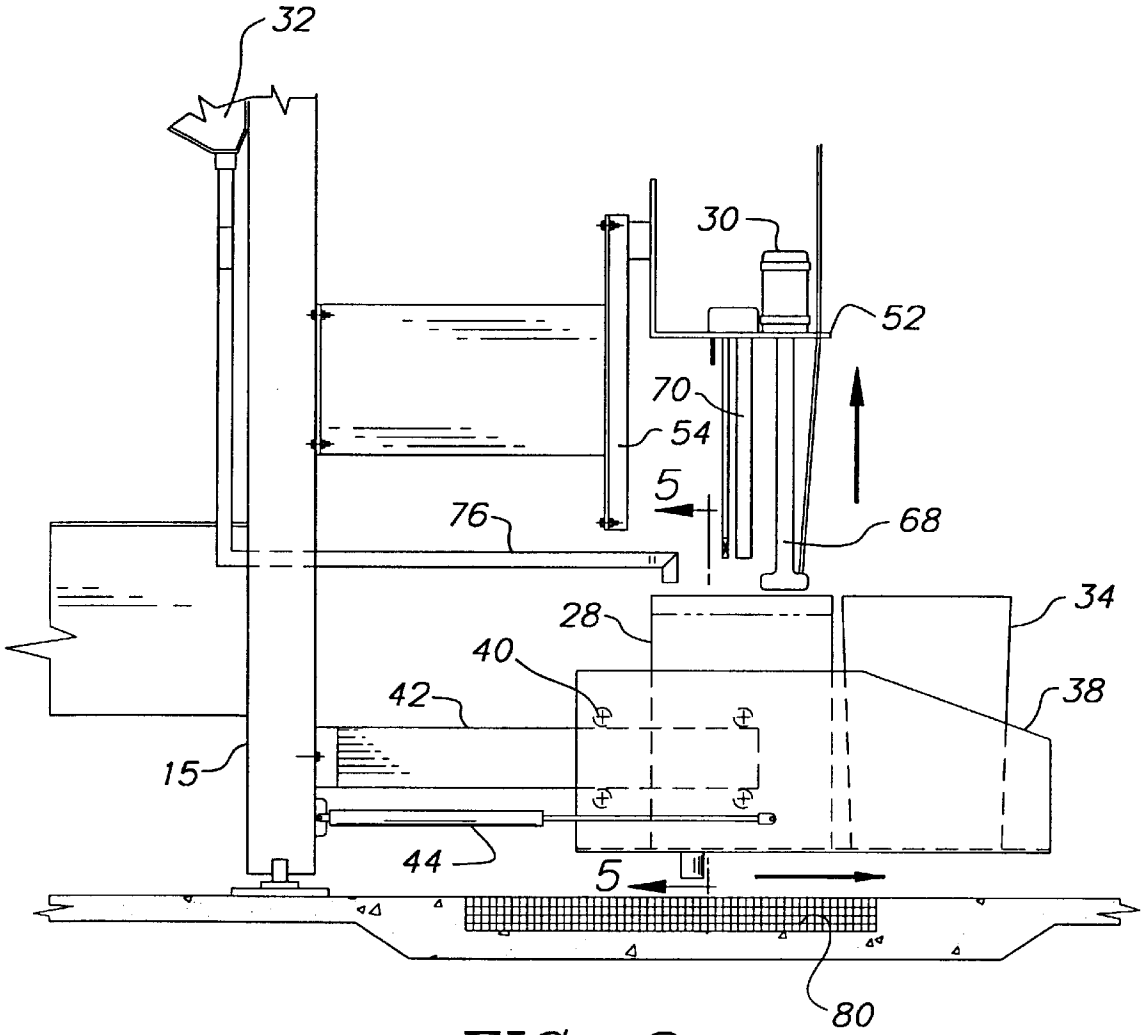
FIG. 2 is a front elevational view enlarged from that of FIG. 1, showing the lid in a raised, transient position.
Figure 3:
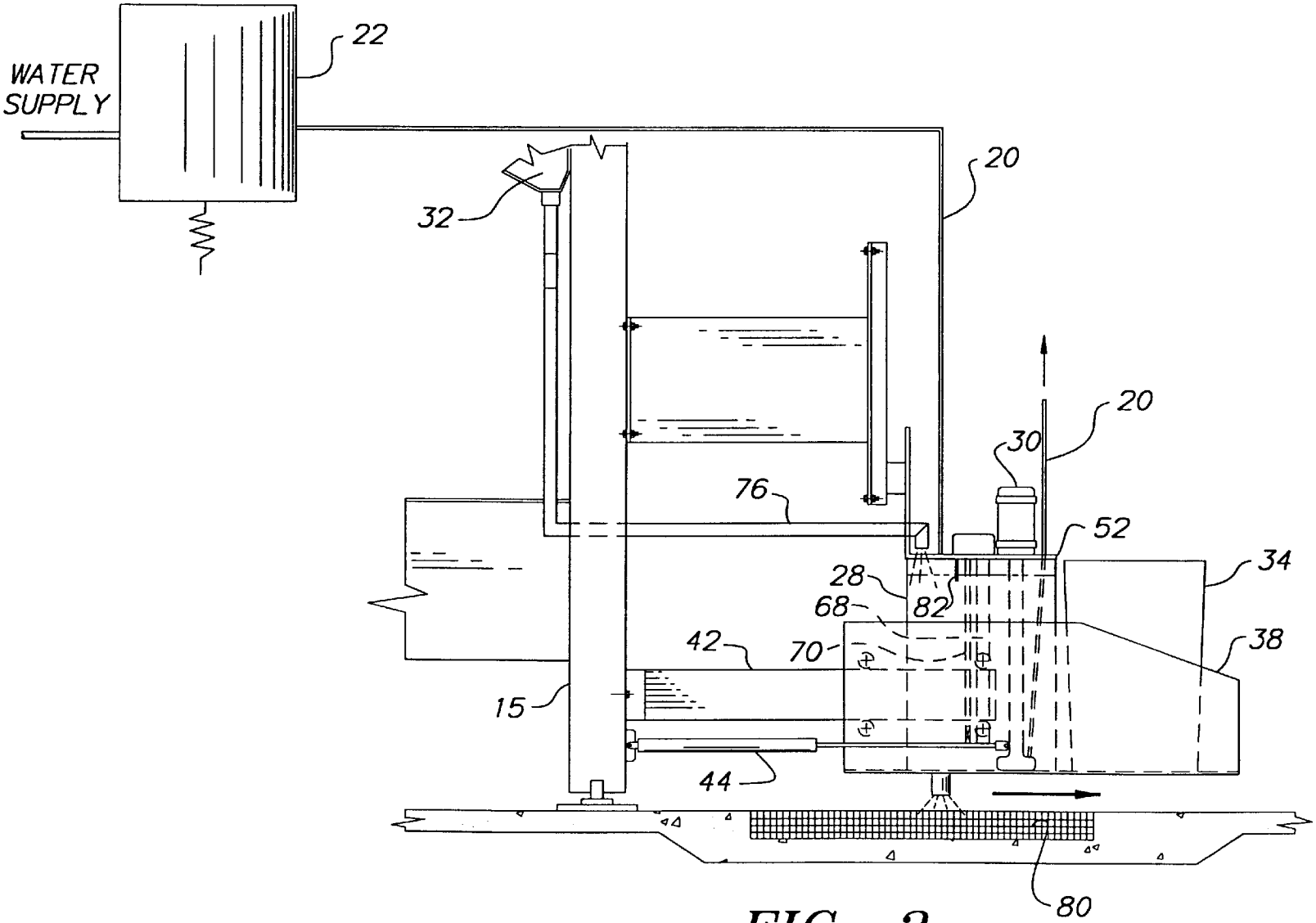
FIG. 3 is a front elevational view similar to FIG. 2 showing the lid in a lowered, operational position and the moveable carriage in a cleaning position.

Referring to FIGS. 2 and 5, in order to facilitate the movement of the ink circulation pump 30 from the ink container 34 to the wash chamber 28, the power wash system 18 has a moveable carriage or platform 38 which carries the wash chamber 28 and receives the ink container 34. The carriage 38 has a plurality of guide wheels 40 moveable along a track 42. The carriage 38 is moved between a printing position as shown in FIG. 1 to a cleaning position as shown in FIGS. 2 and 3 by a hydraulic cylinder 44. The wash chamber 28 has a drain valve 48 for draining the wash chamber 28. The drain value 48 is automatically controlled to open and close when needed.

The apparatus for automatically cleaning and maintaining the measuring devices 10 modifies the automatic power wash system 18 described above. Still referring to FIG. 1, the apparatus 10 has a lid 52 which is moveable between a lowered operation position shown in FIGS. 1 and 3 and a raised transient position as shown in FIG. 2. The lid 52 is moved between the two positions by an air cylinder 54.

Figure 4:
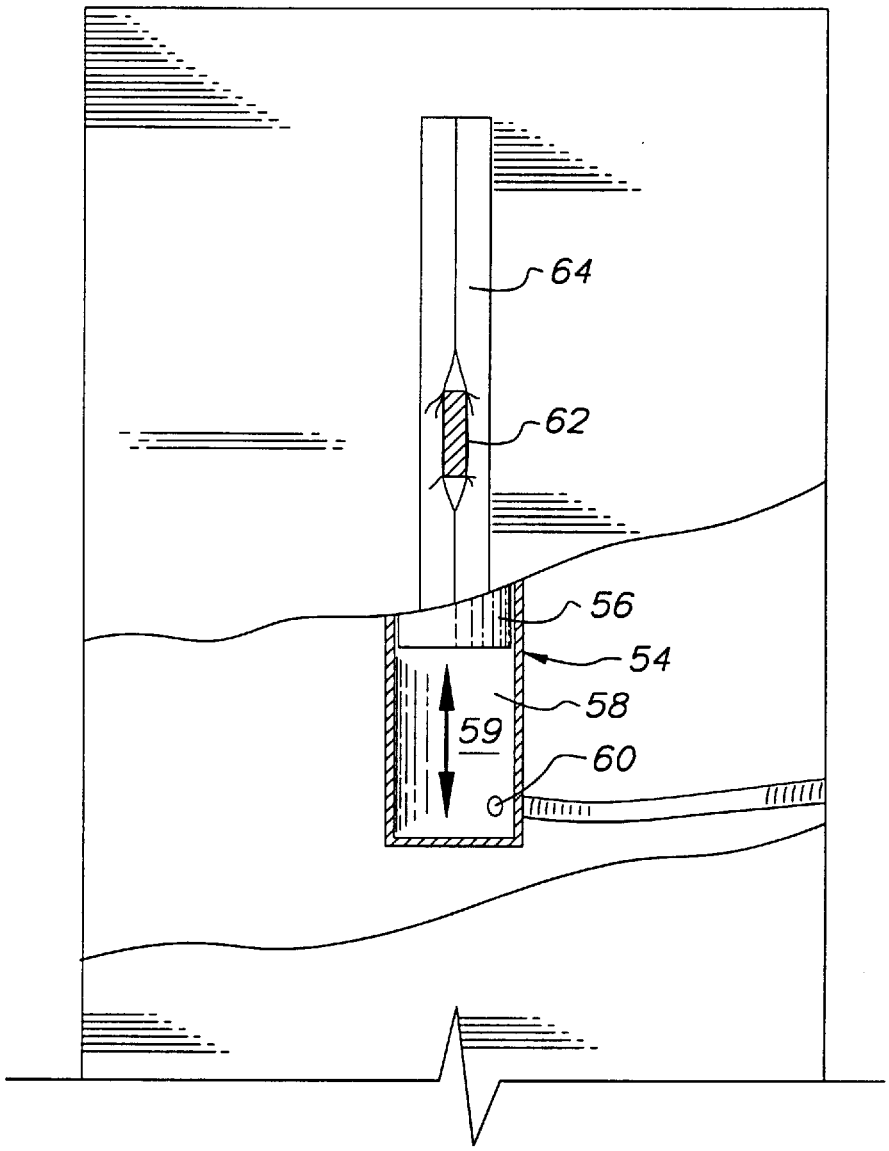
FIG. 4 is a side elevational view of the air cylinder with portions broken away.

Referring to FIG. 4, the air cylinder 54 has a piston 56 located in a bore 58. The bore 58 has a pair of ports 60, only one shown, for pressurizing one side of the piston 56 and evacuating the other side of the piston 56, therein moving the piston 56 upward and downward in the bore 58. The piston 56 has an arm portion 62 that extends outward from the bore 58 through a slideably sealing joint 64. The slideably sealing joint 64 consist of a pair of overlapping rubber seals 66 that seal the bore 58. The air cylinder 54 therein allows the lid 52 to have vertical motion between the lowered operational position and the raised, transient position.

The lid 52, in addition to covering either the ink container 34 or the wash chamber 28, is a rigid platform on which the ink circulation pump 30 is mounted. In addition, a viscosity measuring device 68 and a pH measuring device or probe 70 are mounted to the rigid lid 52. The measuring devices 68 and 70 measure the ink conditions in the ink container 34. It is contemplated that the viscosity meter 68 may either be a torsional type such as sold by Brookfield Engineering Laboratories, Inc. of Stoughton, Mass. or a ball drop type such as sold by Norcross of Newton, Mass. The pH meter 70 is contemplated to be the type as sold by Sensorex of Stanton, Calif.

Figure 6:
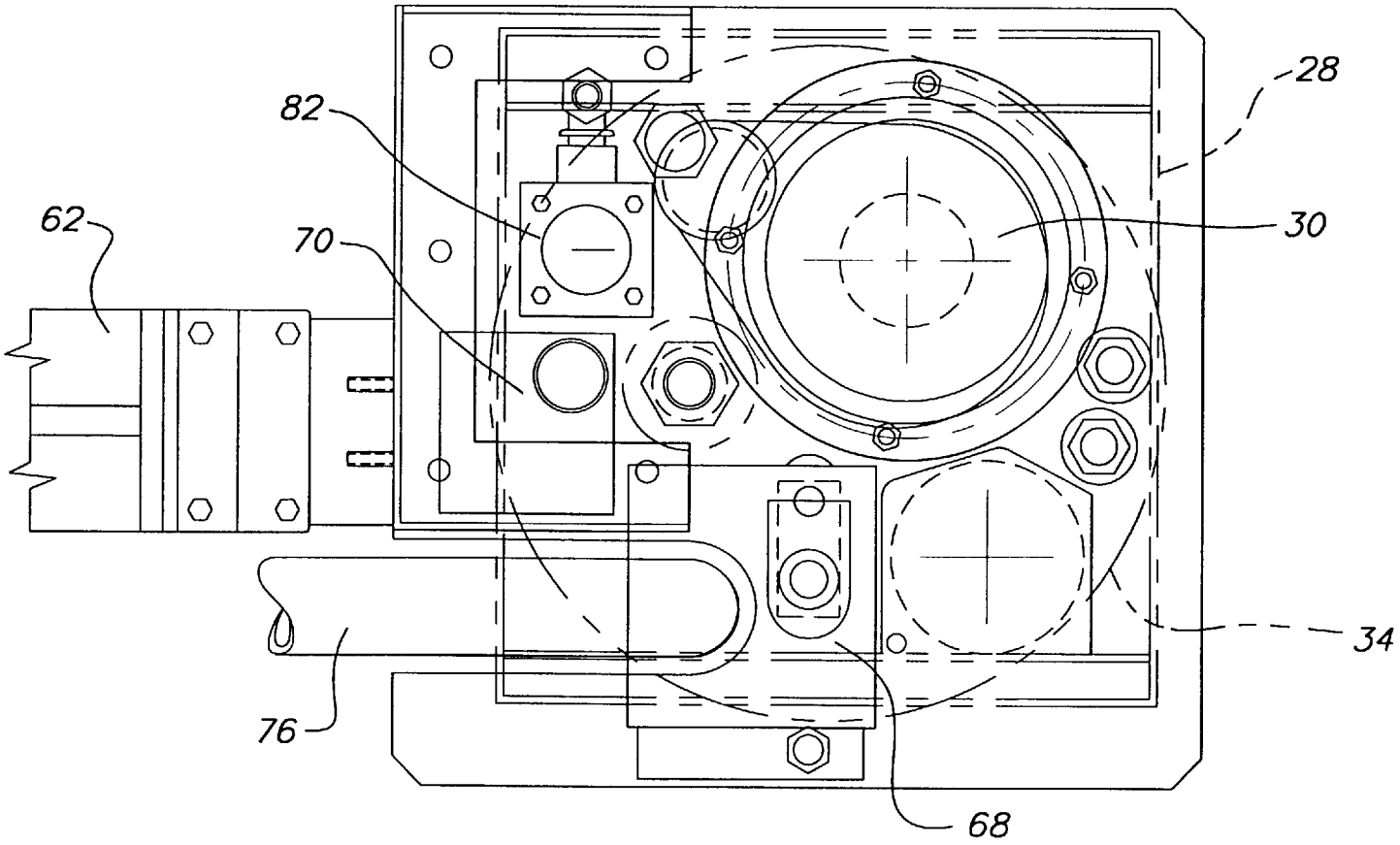
FIG. 6 is a top view of the lid.

Referring to FIG. 6, the lid 52 moves in a pure vertical direction, to prevent the ink circulation pump 30, the viscosity measuring device 68 and the pH measuring device 70 from hitting the walls of the ink container 34 or wash chamber 28 as the lid 52 moves. The wall of the ink container 34 is represented by the circle drawn in phantom in FIG. 6. The walls of the wash chamber 28 are represented by the square drawn in phantom in FIG. 6. As seen in FIG. 5 and represented by the double set of phantom lines on the top and bottom of FIG. 6, the wash chamber 28 has sloped walls.

In Operation

Referring to FIG. 1, during operation, the lid 52 rests on top of the ink container 34 with the ink circulation pump 30 supplying ink to the ink trough of the print station 12 and from there to the anilox roll 16. The ink is returned from the ink trough and drain trough 32 to the ink container 34 through a return tube 76, one of the tubes 20. The viscosity measuring probe 68 and the pH measuring probe 70 are activated when the ink circulation pump 30 is operating.

When the viscosity measuring probe 68 or the pH measuring probe 70 determines that the ink is not at the desired condition, either the operator or the machine automatically adds liquid, such as a solvent or water, to the ink to achieve or approach the desired condition.

Referring to FIG. 1, upon initiation of the automatic wash cycle, a control unit, not shown, actuates the following events. The ink circulation pump 30 is turned off. The air cylinder 54, referring to FIG. 4, is filled with air in a lower portion 59 of the bore 58, urging the arm 62 upward. The arm 62 raises the lid 52, moving the ink circulation pump 30 and viscosity measuring device 68 and pH measuring device 70 out of the ink container 34.

Referring to FIG. 2, the carriage 38 is moved to the extended cleaning position by the hydraulic cylinder 44 pushing the carriage 38 as the guide wheels 40 move along the track 42. In this position, the wash chamber 28 is directly underneath the lid 52 which holds the ink circulation pump 30 and the viscosity measuring device 68 and the pH measuring probe 70. Prior to the movement of the carriage 38, the wash chamber 28 has been filled with a mixture of hot water and detergent.

Referring to FIG. 3, the lid 52 is lowered to the operational position by the air cylinder 54. In this position, the lid 52 rests on top of the wash chamber 28. The ink circulation pump 30 is turned on, pumping the detergent and water from the wash chamber 28 to the ink trough of the print station 12 to wash the system. Water from the ink trough is returned to the wash chamber 28, via drain trough 32 and the return tube 76. The movement of the water by the pump 30 and returning by the return tube 76 causes a circulating action producing agitation in the ink wash chamber 28 which flushes and cleans the viscosity measuring device 68 and pH measuring probe 70. The drain valve 48, which is air operated, is then open allowing the detergent and water mix to flow out of the wash chamber 28 into a floor drain 80. After the wash chamber 28 is drained, the ink circulation pump 30 is turned off and the drain valve 48 is closed.

A solenoid operated water valve supplies clean water through the tubing 20, rinsing out the power wash system 18. The water goes through the lid 52 into the wash chamber 28. The water valve is turned off when the water level in the wash chamber 28 reaches a conductive type liquid sensing probe 82 mounted on the lid 52. The viscosity measuring probe 68 and the pH measuring probe 70 started in this position submerged in water until the operator returns the system to the operating state shown in FIG. 1.

The present invention may be embodied in other specific forms without departing from the spirit or essential attributes thereof and, accordingly, reference should be made to the appended claims, rather than to the foregoing specification, as indicating the scope of the invention.

I claim:

1. A method of maintaining and cleaning a device for measuring a parameter of an ink for use in a print station comprising the following steps:

providing a measuring device for measuring a parameter of the ink;

raising the measuring device out of a container adapted for holding ink;

moving a carriage which carries both a cleaning container and the ink container, such that the cleaning container underlies the measuring device; and lowering the measuring device in the cleaning container for cleaning and maintaining said device.

2. A method as in claim 1 wherein the device for measuring a parameter of the ink moves in a pure vertical direction out of and into both the ink container and the cleaning container.

3. A method as in claim 1 wherein the device for measuring a parameter of the ink is carried by a platform and the measuring device is raised and lowered with the platform.

4. A method as in claim 3 wherein the platform moves in a pure vertical direction and the measuring device moves in a pure vertical direction out of and into both the cleaning container and the ink container.

5. The method of maintaining and cleaning of claim 1, further comprising:

providing a lid having an ink circulation pump, before the raising step;

wherein the raising step further comprises raising the pump out of the ink container;

wherein the lowering step further comprises lowering the pump in the cleaning fluid container; and further comprising the following steps:

washing the print station with a mixture of detergent and water pumping through the station and simultaneously washing the pump and the device for measuring;

rinsing the print station and simultaneously rinsing the pump and the device for measuring; and storing the device for measuring the parameter of ink in the cleaning fluid container so that it is submerged in the fluid within the cleaning container.

6. A method of cleaning and maintaining a device for measuring a parameter of an ink comprising the following steps:

providing a device for measuring a parameter of the ink on a lid of an ink container;

raising the lid to move the device for measuring a parameter of the ink out of the ink container;

moving a carriage carrying both the ink container and a cleaning container such that the cleaning container underlies the measuring device;

lowering the lid to lower the measuring device into the cleaning container;

washing the measuring device in the cleaning container;

rinsing the measuring device; and storing the measuring device in the cleaning container.

7. A method of cleaning a print station comprising the following steps:

providing a lid having an ink circulation pump, the lid carrying a device for measuring a parameter of the ink;

moving the lid vertically to move the pump and the measuring device out of a container for holding ink;

moving a carriage carrying both a cleaning container and the ink container, such that the cleaning container underlies the measuring device;

lowering the lid to place the pump and the measuring device into the cleaning container;

washing the print station with a mixture of detergent and water pumping through the station and simultaneously washing the pump and the device for measuring;

rinsing the print station and simultaneously rinsing the pump and the measuring device; and storing the measuring device in the cleaning container.

8. A method for cleaning a means for measuring a parameter of an ink for use in a print station, comprising the following steps:

(a) providing (i) a lid, the lid carrying means for measuring and controlling at least one of a viscosity of the ink, a pH value of the ink, and both the viscosity and pH value of the ink, and (ii) a movable carriage carrying both an ink container and a cleaning fluid container for cleaning the measuring and controlling means, the carriage being adapted to selectively position under the lid a selected one of the ink container and the cleaning fluid container, and (b) moving the carriage so that the cleaning container is positioned under the lid for cleaning said measuring and controlling means.

9. A method for cleaning a means for measuring a parameter of an ink for use in a print station, comprising the following steps:

(a) providing an apparatus for cleaning a means for measuring a parameter of an ink, the apparatus including a lid, a means for measuring a parameter of the ink extending from the lid, a movable carriage carrying both an ink container and a cleaning fluid container, the lid being movable between a first position adjacent the carriage and a second position away from the carriage, the carriage being movable between a first position in which the measuring means is aligned with the ink container and a second position in which the measuring means is aligned with the cleaning fluid container, the lid and carriage initially being in their respective first positions such that the measuring means is located substantially within the ink container for dispensing ink from the ink container;

(b) moving the lid from the first position to the second position such that the measuring means is substantially out of the ink container;

(c) moving the carriage from the first position to the second position such that the cleaning fluid container is aligned with the measuring means; and (d) moving the lid from the second position to the first position such that the measuring means is located substantially in the cleaning fluid container for washing the measuring means.

10. The method for cleaning according to claim 9 wherein the cleaning apparatus further comprises a pump extending from the lid, means for delivering fluid from the pump to a print station, and means for returning fluid from the print station to at least one of the containers, and wherein the cleaning fluid container contains a cleaning fluid and said method further comprising the step of:

(e) activating the pump to pump the cleaning fluid through the fluid delivery means, to the print station for washing the print station, and recirculating the cleaning fluid via the fluid return means between the print station and the cleaning fluid container for washing the measuring means and the pump.

11. The method for cleaning according to claim 10 further comprising the step of:

(f) draining the cleaning fluid from the cleaning fluid container; filling the cleaning fluid container with water to a preselected level sufficient to cover the measuring means when the measuring means is inserted into the cleaning fluid container; and storing the measuring means in the cleaning fluid container so that the measuring means is submerged in the cleaning fluid.

12. The method for cleaning according to claim 9 wherein the cleaning apparatus further comprises a pump extending from the lid, means for delivering fluid from the pump to a print station, and means for returning fluid from the print station to at least one of the containers, and wherein the cleaning fluid container contains a cleaning fluid and said method further comprising the step of:

(e) activating the pump to pump the cleaning fluid through the fluid delivery means and recirculating the cleaning fluid via the fluid return means between the print station and the cleaning fluid container for washing the measuring means and the pump.

13. An apparatus for cleaning a means for measuring a parameter of an ink for use in a print station, comprising:

a lid, a means for measuring a parameter of the ink extending from the lid, a movable carriage carrying both an ink container and a cleaning fluid container, the lid being movable between a first position adjacent the carriage and a second position away from the carriage, the carriage being movable between a first position in which the measuring means is aligned with the ink container and a second position in which the measuring means is aligned with the cleaning fluid container, the lid and carriage initially being in their respective first positions such that the measuring means is located substantially within the ink container for dispensing ink from the ink container;

means for moving the lid from the first position to the second position such that the measuring means is substantially out of the ink container;

means for moving the carriage from the first position to the second position such that the cleaning fluid container is aligned with the measuring means; and for moving the lid from the second position to the first position such that the measuring means is located substantially in the cleaning fluid container for washing the measuring means.

14. A method for cleaning a means for measuring a parameter of an ink for use in a print station, comprising the following steps:

(a) providing (i) a lid, the lid carrying means for pumping ink for use in the print station and means for measuring and controlling at least one of a viscosity of the ink, a pH value of the ink, and both the viscosity and pH value of the ink, and (ii) a movable carriage carrying both an ink container and a cleaning fluid container for cleaning the measuring and controlling means and, by operation of the pumping means, at least one element of the print station, the carriage being adapted to selectively position under the lid a selected one of the ink container and the cleaning fluid container; and (b) moving the carriage so that the cleaning container is positioned under the lid, whereby the measuring and controlling means and the pumping means are inserted into the cleaning fluid.

* * * * *